US010655911B2

(12) United States Patent
Turner et al.

(10) Patent No.: US 10,655,911 B2
(45) Date of Patent: May 19, 2020

(54) NATURAL GAS LIQUEFACTION EMPLOYING INDEPENDENT REFRIGERANT PATH

(75) Inventors: Terry D. Turner, Idaho Falls, ID (US); Bruce M. Wilding, Idaho Falls, ID (US); Michael G. McKellar, Idaho Falls, ID (US); Dennis N. Bingham, Idaho Falls, ID (US); Kerry M. Klingler, Idaho Falls, ID (US)

(73) Assignee: BATTELLE ENERGY ALLIANCE, LLC, Idaho Falls, ID (US)

( * ) Notice: Subject to any disclaimer, the term of this patent is extended or adjusted under 35 U.S.C. 154(b) by 1229 days.

(21) Appl. No.: 13/528,246

(22) Filed: Jun. 20, 2012

(65) Prior Publication Data

US 2013/0340475 A1 Dec. 26, 2013

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/005* (2013.01); *F25J 1/0042* (2013.01); *F25J 1/0045* (2013.01); *F25J 1/0052* (2013.01); *F25J 1/0204* (2013.01); *F25J 1/025* (2013.01); *F25J 1/0208* (2013.01); *F25J 1/0212* (2013.01); *F25J 1/0219* (2013.01); *F25J 2205/10* (2013.01); *F25J 2205/20* (2013.01);
(Continued)

(58) Field of Classification Search
CPC ..... F25J 1/0022; F25J 1/0042; F25J 1/0045; F25J 1/0212; F25J 1/0219; F25J 2270/902; F25J 1/025; F25J 1/0035; F25J 1/005; F25J 1/0055; F25J 1/0052; F25J 1/0265; F25J 1/0262; F25J 1/0279
USPC ..... 62/611, 612, 614
See application file for complete search history.

(56) References Cited

U.S. PATENT DOCUMENTS 1,222,801 A 4/1917 Rosenbaum
2,037,679 A 4/1936 Dana
(Continued)

FOREIGN PATENT DOCUMENTS

CN 101539362 9/2009
EP 0 676 599 A 10/1995
(Continued)

OTHER PUBLICATIONS

Relations between height, pressure, density and temperature, http://www.aerostudents.com/files/aerodynamicsA/relationsPressureHeight.pdf.
(Continued)

*Primary Examiner* — Keith M Raymond
*Assistant Examiner* — Webeshet Mengesha
(74) *Attorney, Agent, or Firm* — TraskBritt

(57) ABSTRACT

A method of liquefying natural gas. The method comprises cooling a gaseous natural gas process stream with a refrigerant flowing in a path isolated from the natural gas process stream. The refrigerant may differ in composition from a composition of the natural gas process stream, and the refrigerant composition may be selected to enhance efficiency of the refrigerant path with regard to a specific composition of the natural gas process stream. The refrigeration path may be operated at pressures, temperatures and flow rates differing from those of the natural gas process stream. Other methods of liquefying natural gas are described. A natural gas liquefaction plant is also described.

17 Claims, 3 Drawing Sheets

(52) U.S. Cl.
CPC ..... *F25J 2205/84* (2013.01); *F25J 2210/06* (2013.01); *F25J 2220/66* (2013.01); *F25J 2235/60* (2013.01)

(56) References Cited

U.S. PATENT DOCUMENTS 2,037,714 A 4/1936 Gaines, Jr.
2,040,059 A 5/1936 Mesinger
2,093,805 A 9/1937 de Baufre
2,157,103 A 5/1939 Zenner
2,209,534 A 7/1940 Moore
2,379,286 A 6/1945 Dodson
2,494,120 A 1/1950 Ferro, Jr.
2,669,941 A 2/1954 Stafford
2,701,641 A 2/1955 Krijgsman
2,830,769 A 4/1958 Work
2,858,020 A 10/1958 Steen
2,900,797 A 8/1959 Kurata et al.
2,937,503 A 5/1960 Swearingen et al.
3,132,016 A 5/1964 Kurata
3,168,136 A 2/1965 Ammon
3,182,461 A 5/1965 Johanson
3,193,468 A 7/1965 Sprague
3,213,631 A 10/1965 Kniel
3,218,816 A 11/1965 Grenier
3,236,057 A 2/1966 Hashemi-Tafreshi
3,254,496 A 6/1966 Roche et al.
3,283,521 A 11/1966 Harmens
3,289,756 A 12/1966 Jaeger
3,292,380 A 12/1966 Bucklin
3,310,843 A 3/1967 Mancuso
3,312,073 A 4/1967 Jackson et al.
3,315,475 A 4/1967 Harmens
3,323,315 A 6/1967 Carr
3,326,453 A 6/1967 Kun
3,349,020 A 10/1967 Crownover et al.
3,362,173 A 1/1968 Ludwog Kneil
3,376,709 A 4/1968 Dickey et al.
3,406,496 A 10/1968 Betteridge et al.
3,407,052 A 10/1968 Huntress et al.
3,416,324 A 12/1968 Swearingen
3,422,887 A 1/1969 Berkeley
3,448,587 A 6/1969 Goard et al.
3,487,652 A 1/1970 McKay
3,503,220 A 3/1970 Desai
3,516,262 A 6/1970 Bernstein
3,548,606 A 12/1970 Kuerston
3,596,473 A 8/1971 Streich
3,608,323 A 9/1971 Salama
3,616,652 A 11/1971 Engel
3,628,340 A 12/1971 Meisler et al.
3,667,234 A 6/1972 DeLizasoain
3,677,019 A 7/1972 Olszewski
3,690,114 A 9/1972 Swearingen et al.
3,724,225 A 4/1973 Mancini et al.
3,724,226 A 4/1973 Pachaly
3,735,600 A 5/1973 Dowdell et al.
3,846,993 A 11/1974 Bates
3,886,885 A 6/1975 Becker et al.
3,897,226 A 7/1975 Doherty
4,001,116 A 1/1977 Selcukoglu
4,004,430 A 1/1977 Solomon et al.
4,007,601 A 2/1977 Webbon
4,022,597 A 5/1977 Bacon
4,025,315 A 5/1977 Mazelli
4,032,337 A 6/1977 Boyer
4,120,911 A 10/1978 Davidson
4,128,410 A 12/1978 Bacon
4,148,723 A 4/1979 Mozley
4,161,107 A 7/1979 Chernychev et al.
4,183,369 A 1/1980 Thomas
4,187,689 A 2/1980 Selcukoglu et al.
4,294,274 A 10/1981 LeRoy
4,318,723 A 3/1982 Holmes et al.
4,334,902 A 6/1982 Paradowski
4,359,871 A 11/1982 Strass
4,370,150 A 1/1983 Fenstermaker
4,453,956 A 6/1984 Fabbri et al.
4,456,459 A 6/1984 Brundige
4,456,489 A 6/1984 Brundige
4,479,533 A 10/1984 Persson et al.
4,479,536 A 10/1984 Lameris
4,522,636 A 6/1985 Markbreiter et al.
4,528,006 A 7/1985 Vitovec
4,561,496 A 12/1985 Kehrer
4,609,390 A 9/1986 Wilson
4,611,655 A 9/1986 Molignoni
4,645,522 A 2/1987 Dobrotwir
4,654,522 A 3/1987 Gornick et al.
4,783,272 A 11/1988 Patterson et al.
4,798,242 A 1/1989 Kito et al.
4,822,393 A 4/1989 Markbreiter et al.
4,846,862 A 7/1989 Cook
4,869,313 A 9/1989 Fredley
4,970,867 A 11/1990 Herron et al.
4,993,485 A 2/1991 Gorman
4,994,097 A 2/1991 Brouwers
5,003,782 A 4/1991 Kucerija
5,032,143 A 7/1991 Ritakallio
5,036,671 A 8/1991 Nelson et al.
5,062,270 A 11/1991 Haut et al.
5,074,758 A 12/1991 McIntyre
5,174,796 A 12/1992 Davis et al.
5,218,832 A 6/1993 Woolley
5,252,613 A 10/1993 Chang
5,291,736 A 3/1994 Paradowski
5,325,673 A 7/1994 Durr et al.
5,327,730 A 7/1994 Myers et al.
5,375,422 A 12/1994 Butts
5,379,832 A 1/1995 Dempsey
5,386,699 A 2/1995 Myers et al.
5,390,499 A 2/1995 Rhoades et al.
5,419,392 A 5/1995 Maruyama
5,450,728 A 9/1995 Vora et al.
5,473,900 A 12/1995 Low
5,489,725 A 2/1996 Minkkinen et al.
5,505,048 A 4/1996 Ha et al.
5,505,232 A 4/1996 Barclay
5,511,382 A 4/1996 Denis et al.
5,537,827 A 7/1996 Low et al.
5,551,256 A 9/1996 Schmidt
5,600,969 A 2/1997 Low
5,615,561 A 4/1997 Houshmand et al.
5,615,738 A 4/1997 Cameron et al.
5,655,388 A 8/1997 Bonaquist et al.
5,657,643 A * 8/1997 Price ..... 62/612
5,669,234 A 9/1997 Houser et al.
5,701,761 A * 12/1997 Prevost ..... F25J 1/0022 62/613
5,704,227 A 1/1998 Krabbendam
5,718,126 A 2/1998 Capron et al.
5,755,114 A 5/1998 Foglietta
5,755,280 A 5/1998 da Costa et al.
5,799,505 A 9/1998 Bonaquist et al.
5,819,555 A 10/1998 Engdahl
5,836,173 A 11/1998 Lynch et al.
5,916,260 A 6/1999 Dubar
5,950,453 A 9/1999 Bowen et al.
5,956,971 A 9/1999 Cole et al.
5,983,665 A 11/1999 Howard et al.
6,023,944 A 2/2000 Blundell
6,041,620 A 3/2000 Olszewski et al.
6,085,546 A 7/2000 Johnston
6,085,547 A 7/2000 Johnston
6,105,390 A 8/2000 Bingham et al.
6,131,395 A 10/2000 Greene et al.
6,131,407 A 10/2000 Wissolik
6,138,473 A 10/2000 Boyer-Vidal
6,138,746 A 10/2000 Livolsi et al.
6,196,021 B1 3/2001 Wissolik
6,200,536 B1 3/2001 Tonkovich et al.
6,212,891 B1 4/2001 Minta et al.
6,220,052 B1 4/2001 Tate, Jr. et al.
6,220,053 B1 4/2001 Hass, Jr. et al.

(56) References Cited

U.S. PATENT DOCUMENTS

| | | | | |
|---|---|---|---|---|
| 6,250,244 | B1 | 6/2001 | Dubar et al. | |
| 6,295,833 | B1 * | 10/2001 | Hoffart et al. | 62/613 |
| 6,301,927 | B1 | 10/2001 | Reddy | |
| 6,354,105 | B1 | 3/2002 | Lee et al. | |
| 6,367,286 | B1 | 4/2002 | Price | |
| 6,370,910 | B1 | 4/2002 | Grootjans et al. | |
| 6,372,019 | B1 | 4/2002 | Alferov et al. | |
| 6,375,906 | B1 | 4/2002 | Edlund et al. | |
| 6,378,330 | B1 | 4/2002 | Minta et al. | |
| 6,382,310 | B1 | 5/2002 | Smith | |
| 6,389,844 | B1 | 5/2002 | Klein Nagel Voort | |
| 6,390,114 | B1 | 5/2002 | Haandrikman et al. | |
| 6,397,936 | B1 | 6/2002 | Crowley et al. | |
| 6,400,896 | B1 | 6/2002 | Longardner | |
| 6,410,087 | B1 | 6/2002 | Wilde et al. | |
| 6,412,302 | B1 | 7/2002 | Foglietta | |
| 6,425,263 | B1 | 7/2002 | Bingham et al. | |
| 6,427,464 | B1 | 8/2002 | Beaverson et al. | |
| 6,441,263 | B1 | 8/2002 | O'Rear et al. | |
| 6,442,969 | B1 | 9/2002 | Rojey et al. | |
| 6,446,465 | B1 * | 9/2002 | Dubar | 62/613 |
| 6,484,533 | B1 | 11/2002 | Allam et al. | |
| 6,581,409 | B2 | 6/2003 | Wilding et al. | |
| 6,581,510 | B2 | 6/2003 | Koch et al. | |
| 6,694,774 | B1 | 2/2004 | Rashad et al. | |
| 6,742,358 | B2 | 6/2004 | Wilkinson et al. | |
| 6,767,388 | B2 | 7/2004 | Lecomte et al. | |
| 6,793,712 | B2 | 9/2004 | Qualls | |
| 6,962,060 | B2 | 11/2005 | Petrowski et al. | |
| 6,962,061 | B2 | 11/2005 | Wilding et al. | |
| 7,078,011 | B2 | 7/2006 | Morrow et al. | |
| 7,219,512 | B1 | 5/2007 | Wilding et al. | |
| 7,228,714 | B2 | 6/2007 | Howard | |
| 7,231,784 | B2 | 6/2007 | Howard et al. | |
| 7,288,231 | B2 | 10/2007 | Tonkovich et al. | |
| 7,325,415 | B2 | 2/2008 | Amin et al. | |
| 7,469,556 | B2 | 12/2008 | Howard | |
| 7,575,624 | B2 | 8/2009 | Cartwright et al. | |
| 7,591,150 | B2 | 9/2009 | Turner et al. | |
| 7,591,648 | B2 | 9/2009 | Mosiewicz | |
| 7,594,414 | B2 | 9/2009 | Wilding et al. | |
| 7,765,920 | B2 | 8/2010 | Keller | |
| 8,245,727 | B2 | 8/2012 | Mooney et al. | |
| 8,250,883 | B2 | 8/2012 | Migliore et al. | |
| 2003/0196452 | A1 | 10/2003 | Wilding et al. | |
| 2004/0083888 | A1 | 5/2004 | Qualls | |
| 2004/0105812 | A1 | 6/2004 | Tonkovich et al. | |
| 2004/0148962 | A1 | 8/2004 | Rashad et al. | |
| 2004/0177646 | A1 | 9/2004 | Wilkinson et al. | |
| 2005/0056313 | A1 | 3/2005 | Hagen et al. | |
| 2005/0144979 | A1 | 7/2005 | Zollinger et al. | |
| 2005/0183452 | A1 | 8/2005 | Hahn et al. | |
| 2005/0220704 | A1 | 10/2005 | Morrow et al. | |
| 2005/0279132 | A1 | 12/2005 | Eaton et al. | |
| 2006/0048540 | A1 | 3/2006 | Voss et al. | |
| 2006/0053806 | A1 | 3/2006 | Tassel | |
| 2006/0213222 | A1 | 9/2006 | Whitesell | |
| 2006/0218939 | A1 | 10/2006 | Turner et al. | |
| 2007/0017250 | A1 | 1/2007 | Turner | |
| 2007/0107465 | A1 | 5/2007 | Turner et al. | |
| 2007/0137246 | A1 | 6/2007 | McKellar et al. | |
| 2007/0193303 | A1 | 8/2007 | Hawrysz et al. | |
| 2008/0156035 | A1 | 7/2008 | Aspelund et al. | |
| 2008/0264076 | A1 * | 10/2008 | Price et al. | 62/96 |
| 2009/0071634 | A1 | 3/2009 | Turner et al. | |
| 2009/0217701 | A1 * | 9/2009 | Minta et al. | 62/612 |
| 2009/0248174 | A1 | 10/2009 | Taha et al. | |
| 2009/0277217 | A1 | 11/2009 | Ransbarger et al. | |
| 2010/0018248 | A1 | 1/2010 | Fieler et al. | |
| 2010/0088920 | A1 | 4/2010 | LaRou | |
| 2010/0186445 | A1 * | 7/2010 | Minta et al. | 62/606 |
| 2010/0186446 | A1 | 7/2010 | Turner et al. | |
| 2010/0223950 | A1 | 9/2010 | Malsam | |
| 2010/0313597 | A1 | 12/2010 | Bridgwood | |
| 2011/0094261 | A1 | 4/2011 | Wilding et al. | |
| 2011/0094262 | A1 * | 4/2011 | Turner | F25J 1/0022 62/613 |
| 2011/0094263 | A1 * | 4/2011 | Wilding et al. | 62/613 |
| 2011/0196159 | A1 | 8/2011 | DeMunck et al. | |
| 2012/0103012 | A1 | 5/2012 | Turner et al. | |
| 2012/0103428 | A1 | 5/2012 | Turner et al. | |
| 2012/0103561 | A1 | 5/2012 | Turner et al. | |

FOREIGN PATENT DOCUMENTS

| | | | |
|---|---|---|---|
| EP | 1 205 721 | A1 | 5/2002 |
| FR | 2805034 | | 8/2001 |
| GB | 1135871 | | 12/1968 |
| JP | 58-159830 | | 9/1983 |
| JP | 11200817 | A | 7/1999 |
| JP | 2002071861 | A | 3/2002 |
| WO | 88/00936 | | 2/1988 |
| WO | 98/59206 | | 12/1998 |
| WO | 9859205 | | 12/1998 |
| WO | 0144735 | | 6/2001 |
| WO | 03/062725 | A | 7/2003 |
| WO | 03064947 | | 8/2003 |
| WO | 2005114076 | | 12/2005 |
| WO | 2008091316 | A1 | 7/2008 |
| WO | 2010/023238 | | 3/2010 |
| WO | 2010023238 | A1 | 3/2010 |

OTHER PUBLICATIONS

Search Report for PCT/US2006/041039 dated Aug. 8, 2007.
Search Report for PCT/US2007/084677 dated Jul. 1, 2008.
International Preliminary Report for PCT/US08/68938 dated Mar. 16, 2010.
Search Report for PCT/US2010/045340 dated Oct. 13, 2010.
Search Report for PCT/US2010/045332 dated Oct. 18, 2010.
Search Report for PCT/US2008/051012 dated May 20, 2008.
Search Report for PCT/US2010/045321 dated Oct. 21, 2010.
International Preliminary Examination Report for PCT/US2002/20924 dated Jun. 17, 2003.
Search Report for PCT/US1998/027232, dated Jul. 7, 1999.
Bodner Research Web, "Phase Diagrams," http://chemed.chem.purdue.edu/genchem/topicreview/bp/ch14/phase.php.
A National Vision of America's Transition to a Hydrogen Economy—To 2030 and Beyond, Based on the results of the National Hydrogen Vision Meeting Washington, DC Nov. 15-16, 2001, United States Department of Energy.
Curtin University of Technology, LNG Microcell Progress Update, May 2002, Curtin/Corelab.
Generation of Hydrogen and Transportation and Transmission of Energy Generated on the U.S. Outer Continental Shelf to Onshore, (Minerals Management Service), May 2006.
Holmes et al., "Ryan/Holmes Cryogenic Acid Gas/Hydrocarbon Separations Provide Economic Benefits for LNG Production," 7th International Conference on Liquefied Natural Gas; Jakarta, Indonesia; May 1983; Institute of Gas Technology, Session II, vol. 1, pp. 1-15.
Hydrogen as an Energy Carrier and its Production by Nuclear Power, IAEA-TECDOC-1085, International Atomic Energy Agency, May 1999.
Hydrogen Infrastructure Delivery, Reliability R&D Needs, Science Applications International Corporation, Prepared for U.S. Department of Energy, NETL Natural Gas & Infrastructure Reliability Program, 2007, <www.netl.doe.gov/technologies/oil-gas/publications/td/Final%20White%20Paper%20072604.pdf>.
International Search Report for PCT/US02/20924, dated Sep. 17, 2002 (4 pages).
Mott Corporation, "Porous metal solutions," Jun. 2007, 16 pages.
Porous Metal Design Guidebook, Metal Powder Industries Federation, Princeton, NJ, <<http://www.mpif.org/designcenter/porous.pdf >>, Jun. 2007, 25 pages.
The Hydrogen Economy: Opportunities, Costs, Barriers, and R&D Needs, National Academy of Engineering and Board on Energy and Environmental Systems, 2004, The National Academies Press, <http://books.nap.edu/books/0309091632/html/index.html>.

(56) References Cited

OTHER PUBLICATIONS

The Hydrogen Initiative, Panel on Public Affairs, American Physical Society, Mar. 2004, <http://www.aps.org/public_affairs/popa/reports/index.cfm>.
PCT International Preliminary Report on Patentability and Written Opinion for PCT/US2006/041039 dated Apr. 9, 2009, 7 pages.
PCT International Preliminary Report on Patentability and Written Opinion for PCT/US2007/084677 dated May 28, 2009, 7 pages.
PCT International Search Report and Written Opinion for PCT/US08/68938 dated Oct. 10, 2008, 8 pages.
PCT International Preliminary Report on Patentability and Written Opinion for PCT/US2008/051012 dated Aug. 27, 2009, 7 pages.
PCT International Preliminary Report on Patentability and Written Opinion for PCT/US2010/045321 dated Oct. 1, 2010, 6 pages.
PCT International Search Report and Written Opinion for PCT/US2010/045340 dated Oct. 13, 2010, 9 pages.
PCT International Preliminary Report on Patentability and Written Opinion for PCT/US2010/045332 dated Oct. 18, 2010, 11 pages.
PCT International Search Report and Written Opinion of the International Searching Authority for PCT/US2013/044967, dated Oct. 31, 2013 12 pages.

* cited by examiner

NATURAL GAS LIQUEFACTION EMPLOYING INDEPENDENT REFRIGERANT PATH

GOVERNMENT RIGHTS

This invention was made with government support under Contract Number DE-AC07-05ID14517 awarded by the United States Department of Energy. The government has certain rights in the invention.

CROSS-REFERENCE TO RELATED APPLICATIONS

This application is related to U.S. patent application Ser. No. 09/643,420, filed Aug. 23, 2001, for APPARATUS AND PROCESS FOR THE REFRIGERATION, LIQUEFACTION AND SEPARATION OF GASES WITH VARYING LEVELS OF PURITY, now U.S. Pat. No. 6,425,263, issued Jul. 30, 2002, which is a continuation of U.S. patent application Ser. No. 09/212,490, filed Dec. 16, 1998, for APPARATUS AND PROCESS FOR THE REFRIGERATION, LIQUEFACTION AND SEPARATION OF GASES WITH VARYING LEVELS OF PURITY, now U.S. Pat. No. 6,105,390, issued Aug. 22, 2000, which claims the benefit of U.S. Provisional Patent Application Ser. No. 60/069,698 filed Dec. 16, 1997. This application is also related to U.S. patent application Ser. No. 11/381,904, filed May 5, 2006, for APPARATUS FOR THE LIQUEFACTION OF NATURAL GAS AND METHODS RELATING TO SAME, now U.S. Pat. No. 7,594,414, issued Sep. 29, 2009; U.S. patent application Ser. No. 11/383,411, filed May 15, 2006, for APPARATUS FOR THE LIQUEFACTION OF NATURAL GAS AND METHODS RELATING TO SAME, now U.S. Pat. No. 7,591,150, issued Sep. 22, 2009; U.S. patent application Ser. No. 11/560,682, filed Nov. 16, 2006, for APPARATUS FOR THE LIQUEFACTION OF GAS AND METHODS RELATING TO SAME, now abandoned; U.S. patent application Ser. No. 14/536,477, filed Sep. 28, 2006, for APPARATUS FOR THE LIQUEFACTION OF A GAS AND METHODS RELATING TO SAME, now U.S. Pat. No. 7,637,122, issued Dec. 29, 2009; U.S. patent application Ser. No. 14/674,984, filed Feb. 14, 2007, for SYSTEMS AND METHODS FOR DELIVERING HYDROGEN AND SEPARATION OF HYDROGEN FROM A CARRIER MEDIUM, now abandoned, which is a continuation-in-part of U.S. patent application Ser. No. 11/124,589 filed on May 5, 2005, for APPARATUS FOR THE LIQUEFACTION OF NATURAL GAS AND METHODS RELATING TO SAME, now U.S. Pat. No. 7,219,512, issued May 22, 2007, which is a continuation of U.S. patent application Ser. No. 10/414,991 filed on Apr. 14, 2003, for APPARATUS FOR THE LIQUEFACTION OF NATURAL GAS AND METHODS RELATING TO SAME, now U.S. Pat. No. 6,962,061 issued on Nov. 8, 2005, and U.S. patent application Ser. No. 10/414,883, filed Apr. 14, 2003, for APPARATUS FOR THE LIQUEFACTION OF NATURAL GAS AND METHODS RELATING TO SAME, now U.S. Pat. No. 6,886,362, issued May 3, 2005, which is a divisional of U.S. patent application Ser. No. 10/086,066 filed on Feb. 27, 2002, for APPARATUS FOR THE LIQUEFACTION OF NATURAL GAS AND METHODS RELATED TO SAME, now U.S. Pat. No. 6,581,409, issued Jun. 24, 2003, and which claims the benefit of U.S. Provisional Patent Application Ser. No. 60/288,985, filed May 4, 2001, for SMALL SCALE NATURAL GAS LIQUEFACTION PLANT. This application is also related to U.S. patent application Ser. No. 11/855,071, filed Sep. 13, 2007, for HEAT EXCHANGER AND ASSOCIATED METHODS, now U.S. Pat. No. 8,061,413, issued Nov. 22, 2011; U.S. patent application Ser. No. 12/604,194, filed on Oct. 22, 2009, for METHODS OF NATURAL GAS LIQUEFACTION AND NATURAL GAS LIQUEFACTION PLANTS UTILIZING MULTIPLE AND VARYING GAS STREAMS, now U.S. Pat. No. 8,899,074, issued Dec. 2, 2014; U.S. patent application Ser. No. 12/603,948, filed on Oct. 22, 2009, for COMPLETE LIQUEFACTION METHODS AND APPARATUS, now U.S. Pat. No. 8,555,672, issued Oct. 15, 2013; and U.S. patent application Ser. No. 12/604,139, filed on Oct. 22, 2009, for NATURAL GAS LIQUEFACTION CORE MODULES, PLANTS INCLUDING SAME AND RELATED METHODS, now abandoned. This application is also related to U.S. patent application Ser. No. 12/648,659, filed Dec. 29, 2009, for APPARATUS FOR THE LIQUEFACTION OF A GAS AND METHODS RELATING TO SAME, now abandoned; U.S. patent application Ser. No. 12/938,761, filed on Nov. 11, 2010, for VAPORIZATION CHAMBERS AND ASSOCIATED METHODS, pending; U.S. patent application Ser. No. 12/938,826, filed on Nov. 3, 2010, for HEAT EXCHANGER AND RELATED METHODS, pending; and U.S. patent application Ser. No. 12/938,967, filed on Nov. 3, 2010, for SUBLIMATION SYSTEMS AND ASSOCIATED METHODS, pending. The disclosure of each of the foregoing documents is incorporated herein in its entirety by reference. The subject matter of this application is also related to U.S. patent application Ser. No. 13/284,737, filed Oct. 28, 2011, for METHODS OF CONVEYING FLUIDS AND METHODS OF SUBLIMATING SOLID PARTICLES, now U.S. Pat. No. 8,544,295, which is a divisional of U.S. patent application Ser. No. 11/855,071, filed Sep. 13, 2007, now U.S. Pat. No. 8,061,413, issued Nov. 22, 2011.

TECHNICAL FIELD

Embodiments of the present disclosure relate to the compression and liquefaction of gases and, more specifically, the liquefaction of natural gas employing a refrigerant path separate from a process stream.

BACKGROUND

The use of natural gas as an energy source in lieu of other hydrocarbons such as oil and coal is becoming ever more prevalent in the U.S. economy, in light of the discovery of substantial new reserves and the development of improved methods of extraction. The resulting reduction in cost of natural gas, in conjunction with cyclically high and widely variable cost of crude oil, makes natural gas a compelling low-cost and reliable alternative.

Due to the increased interest in using ever-larger volumes of natural gas and the locations of many new natural gas sources distances great enough from existing pipeline and gathering system infrastructure to make pipeline transportation economically impractical due to cost, there is a recognized need for improved product deliver infrastructure. In addition, the ongoing transition of motor vehicles to natural gas fuel necessitates creative solutions for providing access along transportation corridors, many of which are remote from pipelines or in areas where accessing a close pipeline is impractical due to cost, the developed nature of potential access corridors, environmental considerations, and other factors.

One solution to transportation of large quantities of natural gas is liquefaction, many enhancements to which have been developed by the inventors herein. Liquefaction enables transport from pipelines or even directly from a wellhead by truck or rail to points of use in local markets, where the liquid natural gas may be vaporized into a distribution system or used as a higher value liquid product for vehicle fuel, power generation, or industrial processes.

U.S. patent application Ser. No. 12/603,948 discloses a compact natural gas liquefaction process and plant utilizing a source of natural gas for both a natural gas processing loop and a refrigerant loop and enabling substantially all incoming natural gas to exit the plant as liquefied natural gas, avoiding return of natural gas to the source. The incoming gas stream is brought into the plant and circulated through compression, pressure reduction, and heat exchangers, pulling off a product stream equal to the mass flow entering the plant. The recirculation gas is always replenished at the same rate as liquefied gas production. This approach requires the use of larger compressors and flow paths than might otherwise be desirable, due to the continual recirculation process. Further, use of the recirculating design may be constrained in some circumstances by gas composition.

While the process and plant as disclosed in the '948 application facilitates liquefaction of natural gas in situations where natural gas cannot be returned to its source, there are conditions where it is desirable to separate a process stream from a refrigeration path in a compact natural gas liquefaction process and plant. For example, it would be desirable in some instances to avoid mixing of a refrigerant path and a process stream to better perform their respective functions. Separation of the two can, to some degree, reduce complications associated with different gas compositions. By using separate process streams and refrigerant paths, the refrigerant gas may comprise a single component or mixture to meet refrigeration requirements and may comprise any of a variety of refrigerants known by those of ordinary skill in the art, without limitation of selection by the composition of the product stream.

To elaborate on the foregoing, in at least some situations, it would be desirable to be able utilize different material compositions and design parameters (e.g., temperatures, flow rates, pressures) in each of the refrigerant and natural gas flows, as doing so may reduce cooling complications associated with certain natural gas source material compositions and may enable the use of a wider variety of refrigerants. Such a natural gas liquefaction process and plant may also decrease operating costs and increase process and plant efficiencies relative to previous natural gas liquefaction technologies by facilitating the use of smaller equipment (e.g., compressors) and smaller process flow paths. In addition, it would be desirable to have a very efficient method of liquefying natural gas from stranded sources, where there is no opportunity for a tail gas stream.

BRIEF SUMMARY

Embodiments described herein include methods of liquefying natural gas and natural gas liquefaction plants employing refrigerant paths that are isolated from process streams. In accordance with one embodiment described herein, a method of liquefying natural gas comprises cooling a gaseous natural gas process stream with a refrigerant flowing in a loop separate from the process stream. The refrigerant path may, optionally, be selectively communicated with the process stream.

In yet additional embodiments, a natural gas liquefaction plant comprises a natural gas processing path and a separate refrigeration path, which may comprise a loop, isolated from the natural gas processing path. The natural gas processing path and the separate refrigeration path may, optionally, be in selective communication.

BRIEF DESCRIPTION OF THE SEVERAL VIEWS OF THE DRAWINGS

The foregoing and other advantages of the invention will become apparent upon reading the following detailed description and upon reference to the drawings.

DETAILED DESCRIPTION

The following description provides specific details, such as equipment types, stream compositions, and processing conditions (e.g., temperatures, pressures, etc.) in order to provide a thorough description of embodiments of the present disclosure. However, a person of ordinary skill in the art will understand that the embodiments of the present disclosure may be practiced without employing these specific details. Indeed, the embodiments of the present disclosure may be practiced in conjunction with conventional systems and methods employed in the industry. In addition, only those process components and acts necessary to understand the embodiments of the present disclosure are described in detail below. A person of ordinary skill in the art will understand that some process components (e.g., pipelines, line filters, valves, temperature detectors, flow detectors, pressure detectors, and the like) are inherently disclosed herein and that adding various conventional process components and acts would be in accord with the present disclosure. The drawings accompanying the present application are for illustrative purposes only, and are not meant to be actual views of any particular material, device, or system.

Methods and systems for the liquefying natural gas (NG) are described. An NG liquefaction plant, according to embodiments of the disclosure, may be configured and operated to use an NG processing path, which may also be characterized as a stream that is separate from a refrigeration path to generate a liquid natural gas (LNG) product. In some embodiments, the NG processing path and the refrigeration path may each comprise "loops," as is conventional to describe paths enabling at least some fluid recirculation, although some or all of the respective processing and refrigeration paths may not comprise "loops" in the strict sense of the term. Employing a refrigeration path that is separate from the NG processing path may enable greater flexibility in refrigerant selection and use, which may result in increased process efficiency (e.g., reducing equipment and energy requirements relative to previous NG liquefaction technologies) and may also expand NG liquefaction operations to site locations that were previously impractical or unfeasible.

A number of different refrigerants may be employed in the refrigeration loop, depending upon the cooling properties desired. One contemplated cooling mixture may comprise methane, ethane and propane with, optionally, a small quantity of nitrogen. The precise mixture employed will depend on the refrigeration properties sought to be achieved by the plant designer, who may also alter pressures, temperatures and flow rates employed in the refrigeration path in conjunction with the selected refrigerant composition independently of the same parameters in the NG processing path for enhanced efficiency. A refrigerant devoid of $CO_2$ may be employed to eliminate the need for removal components.

Figure 1:
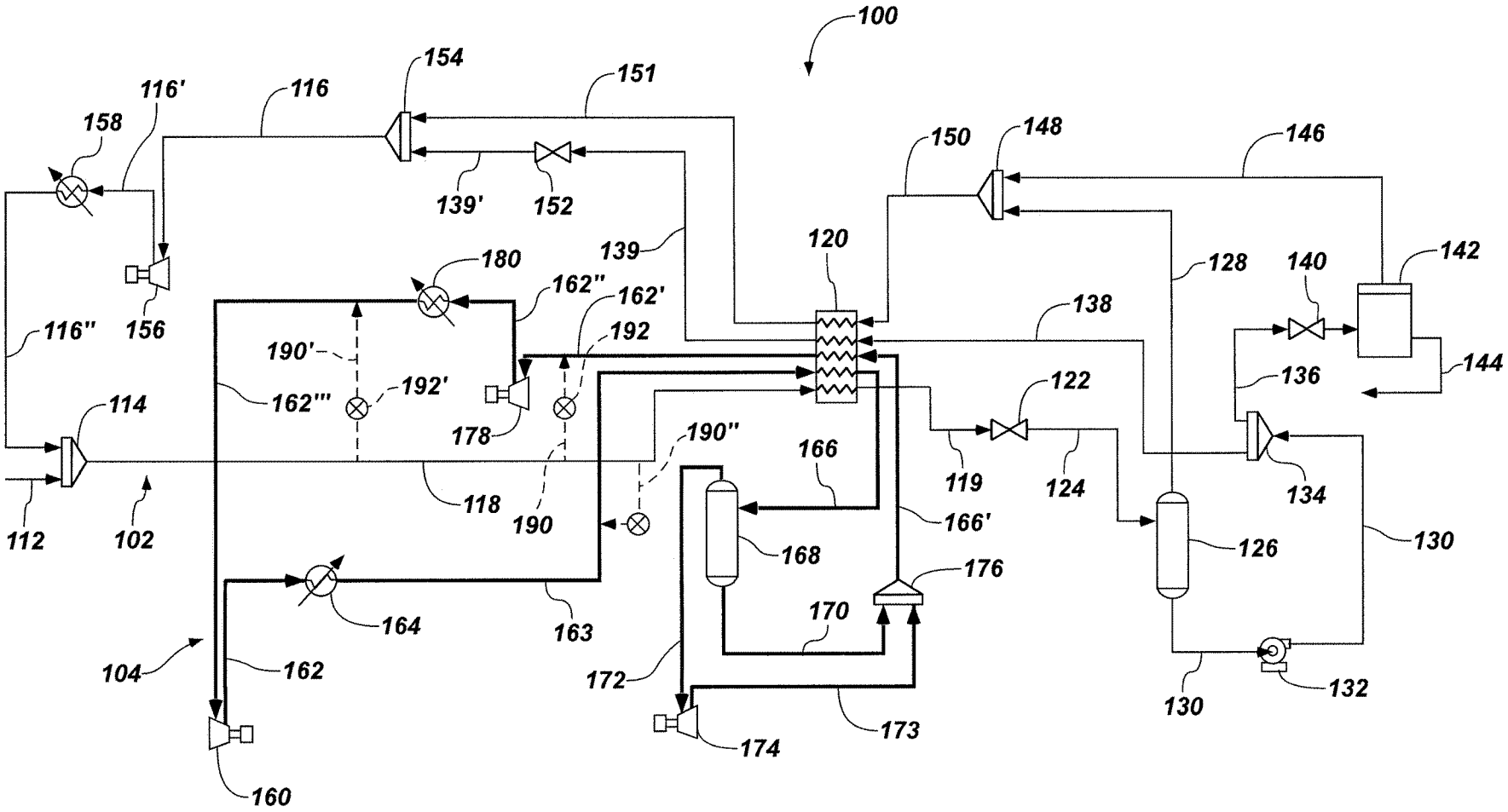
FIG. 1 is a schematic view of a natural gas liquefaction plant, in accordance with an embodiment of the present disclosure.

One embodiment of the present disclosure will now be described with reference to FIG. 1, which schematically illustrates an NG liquefaction plant 100. The NG liquefaction plant 100 may include an NG processing path 102 and a refrigeration path 104 (identified relative to the NG processing path 102 by a bold line), each of which are described in detail below. In the embodiment of FIG. 1, a mass ratio between refrigeration path 104 and an incoming gas stream (gaseous NG feed stream 112) is about 7.75:1.

In the NG processing path 102, a gaseous NG feed stream 112 is received into a mixer 114. The gaseous NG feed stream 112 may have been previously processed to remove impurities, such as carbon dioxide ($CO_2$) and water ($H_2O$). Within the mixer 114, the gaseous NG feed stream 112 may be mixed or combined with a gaseous NG return stream 116 (described in detail below) to form a gaseous NG process stream 118. The gaseous NG process stream 118 may be directed from the mixer 114 into a first channel of a primary heat exchanger 120, wherein the temperature of the gaseous NG process stream 118 may be decreased. The primary heat exchanger 120 may be any suitable device or apparatus known in the art for exchanging heat from one fluid or gas to another fluid, such as a high performance aluminum multi-pass plate and fin-type heat exchanger, available from numerous sources, including Chart Industries Inc., 1 Infinity Corporate Centre Drive, Suite 300, Garfield, Heights, Ohio 44125. The gaseous NG process stream 119 exiting primary heat exchanger 120 may be directed into a pressure-reducing device 122 to form a multi-phase NG process stream 124 including a liquid phase and a gaseous phase. The pressure-reducing device 122 may be any suitable pressure-reducing device including for the sake of example only, but not limited to, a Joule-Thomson expansion valve, a Venturi device, a liquid expander, a hydraulic turbine, and a control valve.

Upon exiting the pressure-reducing device 122, the multi-phase NG process stream 124 may be directed into a gas-liquid separation vessel 126, such as a surge tank. Within the gas-liquid separation vessel 126, the liquid phase and the gaseous phase of the multi-phase NG process stream 124 may be separated to form a separation vessel vent stream 128 and an LNG process stream 130. The LNG process stream 130 may be directed into a pump 132 to increase the pressure of the LNG process stream 130. The LNG process stream 130 may be directed from the pump 132 into a splitter 134, wherein the LNG process stream 130 may be separated into a primary LNG stream 136 and an LNG side stream 138. In at least some embodiments, a mass ratio of the primary LNG stream 136 to the LNG side stream 138 may be within a broad range of from about 3:1 to about 9:1. More narrow, specific ranges which may be employed include, by way of example only and not limitation, from about 4:1 to about 7:1, and from about 5:1 to about 6:1. The primary LNG stream 136 may be directed through a valve 140, and into a storage vessel 142. An LNG product stream 144 may be directed from the storage vessel 142, to be utilized as desired. The LNG side stream 138 may be fed into a second channel of the primary heat exchanger 120, where the LNG side stream 138 may be used to extract heat at least from the gaseous NG process stream 118 in the first channel and be vaporized to form a gaseous NG side stream 139. The gaseous NG side stream 139 may then be directed from the primary heat exchanger 120, through a valve 152, and into a mixer 154 for further treatment, as described in detail below.

The separation vessel vent stream 128 may be directed from the gas-liquid separation vessel 126 into a mixer 148. Within the mixer 148, the separation vessel vent stream 128 may be mixed or combined with a storage vessel vent stream 146 from the storage vessel 142 to form a combined vent stream 150. It should be noted that the separation vessel vent stream 128 and storage vessel vent stream 146 balance the liquid production and storage vessel pressures. The combined vent stream 150 may be directed from the mixer 148 into a third channel of the primary heat exchanger 120, wherein the combined vent stream 150 may be used to extract heat at least from the gaseous NG process stream 118 entering the first channel of the primary heat exchanger 120. The combined vent stream 150 may exit the primary heat exchanger 120 as stream 151 at an increased temperature, and may be fed into the mixer 154, where it may be mixed or combined with the gaseous NG side stream 139' to form the gaseous NG return stream 116. The gaseous NG return stream 116 may be directed from the mixer 154 into at least one compressor 156, such as a single-stage or multiple-stage positive-displacement compressor (e.g., reciprocating compressor, rotary screw compressor), or a single-stage or multiple-stage dynamic compressor (e.g., centrifugal compressor, axial compressor) to form compressed gaseous NG return stream 116'. The at least one compressor 156 may be used to increase the pressure of the compressed gaseous NG return stream 116' as may be required to combine the gaseous NG return stream 116' with the gaseous NG feed stream 112. The gaseous NG return stream 116' may exit the at least one compressor 156 and may be directed through at least one heat exchanger 158, such as an ambient heat exchanger (i.e., which may transfer heat from the gaseous NG return stream 116 to ambient air) or a fluid-cooled heat exchanger (i.e., which may transfer heat the gaseous NG return stream 116' to a separate fluid), to decrease the temperature of the gaseous NG return stream 116' and form cooled gaseous NG return stream 116". The cooled gaseous NG return stream 116" may then be fed into the mixer 114 to combine with the gaseous NG feed stream 112 and form NG process stream 118, facilitating another pass through the NG processing loop 102.

With continued reference to FIG. 1, in the refrigeration path 104, which comprises a closed loop that is separate from the NG processing loop 102, a gaseous refrigerant stream 162 may be directed from a turbo compressor 160 at a pressure, for example, of about 722 psia, into a heat exchanger 164. The gaseous refrigerant stream 162 may, as noted above, include a material composition exhibiting favorable characteristics with regard to the composition of a specific natural gas stream being processed at a site location of the NG processing plant 100. The turbo compressor 160 may be any turbo compressor capable of increasing the pressure of a gas stream. Suitable turbo compressors are commercially available from numerous sources including, but not limited to, GE Oil and Gas, 1333 West Loop South, Houston, Tex. 77027-9116, USA. In at least some embodiments the gaseous refrigerant stream 162 exiting the turbo compressor 160 may have a pressure within a broad range of from about 600 psia to about 900 psia. More narrow, specific ranges which may be employed include, by way of example only and not limitation, from about 700 psia to about 800 psia, and from about 700 psia to about 750 psia. The heat exchanger 164 may be any known device or apparatus suitable for decreasing the temperature of gaseous refrigerant stream 162 to a lower temperature refrigerant stream 163 of, for example, about 100° F., such as an ambient heat exchanger or a fluid-cooled heat exchanger.

Upon exiting the heat exchanger 164, the gaseous refrigerant stream 163 may be fed into a fourth channel of the primary heat exchanger 120. Within the primary heat exchanger 120 the temperature of the gaseous refrigerant stream 163 may be decreased to, for example, about −80° F., to form an at least partially gaseous refrigerant stream 166, which may include a gaseous phase and a liquid phase. In one or more embodiments, the at least partially gaseous refrigerant stream 166 may be at least substantially gaseous. The temperature of the at least partially gaseous refrigerant stream 166 may be within a broad range of from about −40° F. to about −120° F. More narrow, specific ranges which may be employed include, by way of example only and not limitation, from about −60° F. to about −100° F., and from about −75° F. to about −85° F. Upon exiting the primary heat exchanger 120, the at least partially gaseous refrigerant stream 166 may flow into a liquid-gas separation vessel 168, such as a surge tank, wherein the gaseous phase and the liquid phase (if present) of the at least partially gaseous refrigerant stream 166 may be separated to form a liquid refrigerant stream 170 and a gaseous refrigerant side stream 172. The gaseous refrigerant side stream 172 may be directed into a turbo expander 174, where it is expanded to form gaseous refrigerant side stream 173. At least in embodiments where the at least partially gaseous refrigerant stream 166 is completely gaseous, the liquid-gas separation vessel 168 may be omitted, and at least partially gaseous refrigerant stream 166 may be fed directly into the turbo expander 174. The turbo expander 174 may be any known centrifugal or axial flow turbine capable of decreasing the pressure and temperature of the gaseous refrigerant side stream 172. Suitable turbo expanders are commercially available from numerous sources including, but not limited to, GE Oil and Gas, 1333 West Loop South, Houston, Tex. 77027-9116, USA. In at least some embodiments, the gaseous refrigerant side stream 173 may exit the turbo expander 174 at a pressure within a range of from about 20 psia to about 250 psia. More narrow, specific ranges which may be employed include, by way of example only and not limitation, from about 20 psia to about 120 psia, 160 psia to about 200 psia, and about 170 psia to about 190 psia. In one or more embodiments, the gaseous refrigerant side stream 173 may exit the turbo expander 174 at a temperature within a range of from about −120° F. to about −230° F. More narrow, specific ranges which may be employed include, by way of example only and not limitation, from about −150° F. to about −200° F., and from about −165° F. to about −185° F.

The gaseous refrigerant side stream 173 may be passed from the turbo expander 174 into a mixer 176, where the gaseous refrigerant side stream 173 may be mixed or combined with the liquid refrigerant stream 170 from the liquid-gas separation vessel 168 to again form the at least partially gaseous refrigerant stream 166'. At least in embodiments where the at least partially gaseous refrigerant stream 166' is completely gaseous, the mixer 176 may be omitted. The at least partially gaseous refrigerant stream 166' may be directed from the mixer 176 into a fifth channel of the primary heat exchanger 120, where the at least partially gaseous refrigerant stream 166' may be used to extract heat at least from the gaseous NG process stream 118 entering primary heat exchanger 120 and reform a gaseous refrigerant stream 162'. The gaseous refrigerant stream 162' exits the primary heat exchanger 120 and may be directed into at least one compressor 178 to form compressed gaseous refrigerant stream 162". The at least one compressor 178 may be any known compressor capable of increasing the pressure of the gaseous refrigerant stream 162', such as a single-stage or multiple-stage positive-displacement compressor (e.g., reciprocating compressor, rotary screw compressor), or a single-stage or multiple-stage dynamic compressor (e.g., centrifugal compressor, axial compressor). In at least some embodiments, the gaseous refrigerant stream 162' may exit the compressor 178 at a pressure within a range of from about 400 psia to about 600 psia. More narrow, specific ranges which may be employed include, by way of example only and not limitation, from about 450 psia to about 550 psia, and from about 475 psia to about 525 psia. The compressed gaseous refrigerant stream 162" may be directed out of the at least one compressor 178 and into at least one heat exchanger 180, such as an ambient heat exchanger or a fluid-cooled heat exchanger, which may decrease the temperature of the gaseous refrigerant stream 162", forming cooled gas refrigerant stream 162'''. The at least one compressor 178 and the at least one heat exchanger 180 may be provided as a single device or as separate devices. In at least some embodiments, the cooled gaseous refrigerant stream 162''' may exit the at least one heat exchanger 180 at a temperature within a range of from about 50° F. to about 150° F. More narrow, specific ranges which may be employed include, by way of example only and not limitation, from about 75° F. to about 125° F., and from about 90° F. to about 110° F. The cooled gaseous refrigerant stream 162''' may be directed from the at least one heat exchanger 180 into the turbo compressor 160, facilitating another pass through the refrigeration path 104.

The compressors 156, 160, and 178 may each be powered by any suitable energy source known in the art including, but not limited to, one or more of an electric motor, an internal combustion engine, and a gas turbine engine. In at least some embodiments, to reduce the power requirement of the NG processing plant 100, the at least one compressor 156 the may be omitted, and the gaseous NG return stream 116 may be flared or used for a different purpose, such as powering at least one of the turbo compressor 160 and the at least one compressor 178. In additional embodiments, the at least one compressor 156 may be included, but a portion of the gaseous NG return stream 116 exiting the mixer 154 may be directed to a different use (e.g., powering other components of the NG processing plant 100). Further, in one or more embodiments, the energy required to power the turbo compressor 160 may be provided by the turbo expander 174, such as by connecting the turbo expander 174 to the turbo compressor 160, or by using the turbo expander 174 to drive an electrical generator (not shown) that produces electrical energy to power an electrical motor (not shown) of the turbo compressor 160.

In at least some embodiments, the refrigerant used in the refrigeration path 104 may be of the same material composition as a stream of the NG processing path 102. For example, in some situations a means (e.g., conduit) may be provided to connect the refrigeration path 104 to the LNG product stream 144, enabling the NG processing path 102 and the refrigeration path 104 to utilize the same gas. The LNG from LNG product stream 144 may be pumped into the refrigeration path 104, pressure reduced into the refrigeration path 104, or maintained at the same pressure between the NG processing path 102 and the refrigeration path 104. The connection between the NG processing path 102 and the refrigeration path 104 may be open or may be selectively controlled to replace any fugitive gas by use of means of controlling the connection (e.g., a valve) between the NG processing path 102 and the refrigeration path 104. A one-way valve may be employed to avoid release and back flow of refrigerant into the processing path 102. Connecting the NG processing path 102 and the refrigeration path 104 may be desirable at least where the material composition of the LNG product stream 144 exhibits characteristics desired for the refrigerant of the refrigeration path 104.

Another connection arrangement which may be suitable for more situations is to extend a conduit 190 as shown in broken lines between NG process stream 118 downstream of primary heat exchanger 120, and refrigeration path 104. Flow from NG process stream 118 into, for example, gaseous refrigerant stream 162' may be selectively controlled by a valve 192. Alternatively, a conduit 190' may be extended from NG process stream 118 to cooled gaseous refrigerant stream 162''' and flow may be selectively controlled by a valve 192'. Either arrangement would provide a cooling gas, which is the same as the gas of the process stream, and in most cases would not have to be compressed for introduction to the refrigeration path 104. Gas from the LNG product stream, on the other hand, would have to be pumped or warmed and compressed for introduction to the refrigerant path.

Yet another connection arrangement which may be suitable if gas pressure in NG process stream is sufficiently high is to extend a conduit 190" as shown in broken lines between NG process stream 118 upstream of primary heat exchanger 120 and refrigeration path 104. Flow from NG process stream 118 into lower temperature refrigerant stream 163 may be selectively controlled by a valve 192. This arrangement would provide a cooling gas which is the same as the gas of the process stream, and in most cases would not have to be compressed for introduction to the refrigeration path 104.

In other embodiments, the refrigerant fluid used in the refrigeration path 104 may at least partially differ from a composition of the fluid stream passing through the NG processing path 102. In further embodiments, the refrigerant fluid used in the refrigeration path 104 may be completely different in composition from the fluid stream passing through the NG processing path 102.

Total required plant compression and associated power requirements may be reduced by eliminating the return gas loop through compressor 156. The gas flowing through mixer 154 may instead be used to power compressors in the refrigeration path 104, be flared, or be retasked for other uses. This gas might, alternatively, be placed in a low-pressure gas transmission or distribution line. Depending on the required pressure for such a line, compressor 156 may or may not be required.

The size and power requirements of compressor 156 may also be reduced by other uses of the volume of gas flowing into it as, for example to power other equipment, heaters, etc.

It is notable that, by keeping separate the refrigeration path 104 from the process path 102, greater refrigeration flexibility is possible, as only the process stream need be considered for cleanup of, for example, solid $CO_2$.

In at least some embodiments, the refrigeration path 104 may include at least one auxiliary cooling path (not shown) that may be used to augment a cooling capability of the refrigeration path 104. The at least one auxiliary cooling path may be a closed loop. A refrigerant of at least one auxiliary cooling path may be the same as or different than the refrigerant of the refrigeration path 104. In at least some embodiments, the auxiliary cooling path utilizes nitrogen, or a nitrogen-containing gas.

Figure 2:
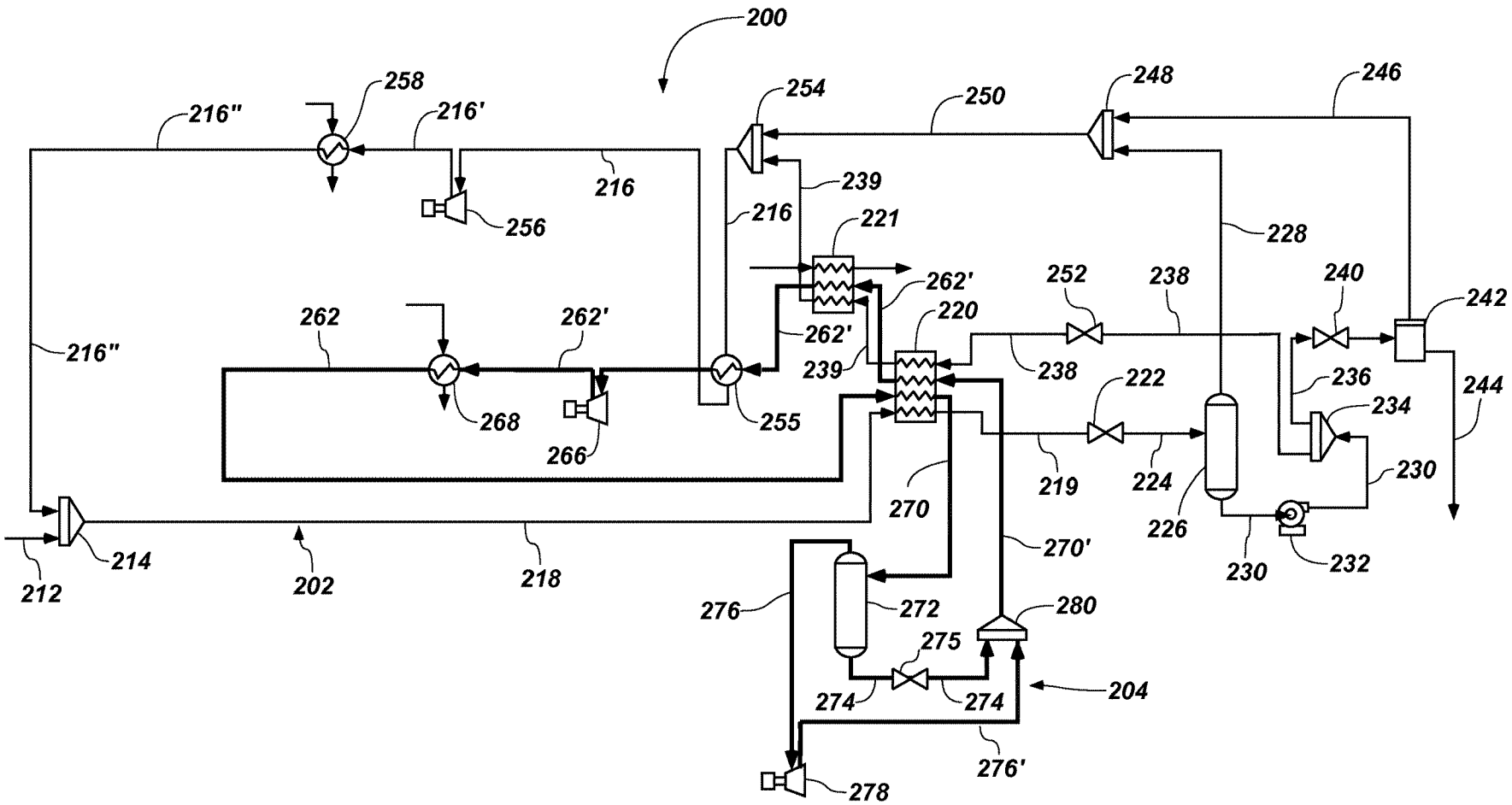
FIG. 2 is a schematic view of a natural gas liquefaction plant, in accordance with another embodiment of the present disclosure.

Another embodiment of the present disclosure will now be described with reference to FIG. 2, which schematically illustrates an NG liquefaction plant 200. The NG liquefaction plant 200 of FIG. 2 is similar to the NG liquefaction plant 100 of FIG. 1, but includes modifications that may increase process efficiency, reduce operational costs, or both. The NG liquefaction plant 200 may include an NG processing path 202 and a refrigeration path 204 (identified relative to the NG processing path 202 by a bold line), each of which are described in detail below.

Referring to FIG. 2, in the NG processing path 202, a mixer 214 may receive a gaseous NG feed stream 212. The gaseous NG feed stream 212 may have been previously processed to remove impurities, such as carbon dioxide ($CO_2$) and water ($H_2O$). Within the mixer 214, the gaseous NG feed stream 212 may be mixed or combined with a gaseous NG return stream 216 (described in detail below) to form a gaseous NG process stream 218. The gaseous NG process stream 218 may be directed from the mixer 214 into a first channel of a first high efficiency heat exchanger 220, wherein the temperature of the gaseous NG process stream 218 may be decreased. A gaseous NG process stream 219 may exit the first high efficiency heat exchanger 220 and may be fed into a pressure-reducing device 222. Non-limiting examples of suitable pressure-reducing devices include a Joule-Thomson expansion valve, Venturi device, liquid expander, control valve, hydraulic turbine, etc. A multi-phase NG process stream 224 including a liquid phase and a gaseous phase exits pressure-reducing device 222. Upon exiting the pressure-reducing device 222, the multi-phase NG process stream 224 may be directed into a gas-liquid separation vessel 226, such as a surge tank. Within the gas-liquid separation vessel 226 the liquid phase and the gaseous phase of the multi-phase NG process stream 224 may be separated to form each of a separation vessel vent stream 228 and an LNG process stream 230. The LNG process stream 230 may be directed into the intake of a pump 232 to increase the pressure of the LNG process stream 230. The LNG process stream 230 may be passed from the pump 232 into a splitter 234, wherein the LNG process stream 230 may be separated into a primary LNG stream 236 and an LNG side stream 238. The primary LNG stream 236 may be directed through a valve 240, and into a storage vessel 242. An LNG product stream 244 may be directed from the storage vessel 242, and may be utilized as desired.

The LNG side stream 238 may be directed through a valve 252, and into a second channel of the first high efficiency heat exchanger 220, where LNG side stream 238 may extract heat at least from the gaseous NG process stream 218 in the first channel, and may be vaporized to form a gaseous NG side stream 239. The gaseous NG side stream 239 may be directed from the first high efficiency heat exchanger 220 into a first channel a second high efficiency heat exchanger 221. As the second high efficiency heat exchanger 221 is separate from the first high efficiency heat exchanger 220, two-phase loads within the first high efficiency heat exchanger 220 may be reduced and the second high efficiency heat exchanger 221 may principally receive gaseous streams, which may equalize heat transfer characteristics of the first high efficiency heat exchanger 220 and the second high efficiency heat exchanger 221 to support efficient heat exchange in each of the heat exchangers. Upon exiting the second high efficiency heat exchanger 221, the gaseous NG side stream 239 may be fed into a mixer 254 for further treatment, as described in detail below.

The separation vessel vent stream 228 may be directed from the gas-liquid separation vessel 226 into a mixer 248. Within the mixer 248, the separation vessel vent stream 228 may be mixed or combined with a storage vessel vent stream 246 from the storage vessel 242 to form a combined vent stream 250. It should be noted that the separation vessel vent stream 228 and storage vessel vent stream 246 balance the liquid production and storage vessel pressures. The combined vent stream 250 may exit the mixer 248 and may be directed into the mixer 254, wherein the combined vent stream 250 may be mixed or combined with the gaseous NG side stream 239 to form the gaseous NG return stream 216. The gaseous NG return stream 216 may exit the mixer 254 and may be passed through a heat exchanger 255, to bring the temperature of the combined gaseous NG return stream 216 and that of gaseous refrigerant stream 262, referenced below, as close as possible to minimize required power input for at least one compressor 256 downstream in flow path 202 and downstream in refrigerant path 204 as described below. The heat exchanger 255 may be any suitable apparatus or device known in the art for exchanging heat from one fluid to another fluid, such as a parallel flow heat exchanger. The gaseous NG return stream 216 may be directed from the heat exchanger 255 into at least one compressor 256, such as a single-stage or multiple-stage positive-displacement compressor (e.g., reciprocating compressor, rotary screw compressor) or a single-stage or multiple-stage dynamic compressor (e.g., centrifugal compressor, axial compressor), to increase the pressure of the gaseous NG return stream 216 and form compressed gaseous NG return stream 216'. The compressed gaseous NG return stream 216' may be directed out of the at least one compressor 256 and into at least one heat exchanger 258, such an ambient heat exchanger or a fluid-cooled heat exchanger, which may decrease the temperature of the gaseous NG return stream 216' to form cooled gaseous NG return stream 216". In at least some embodiments, the at least one heat exchanger 258 is a water-cooled heat exchanger. Heated water exiting the at least one heat exchanger 258 may, optionally, be cooled (e.g., by way of a water cooling tower) and recycled back to the at least one heat exchanger 258. The at least one compressor 256 and the at least one heat exchanger 258 may be provided as a single device or as separate devices. The cooled gaseous NG return stream 216" may exit the heat exchanger 258 and directed into the mixer 214. In at least some embodiments, one or more compressors and heat exchangers may be provided downstream of the at least one heat exchanger 258 and upstream of the mixer 214 to further control at least one of the temperature and pressure of the gaseous NG return stream 216. Within the mixer 214, the cooled gaseous NG return stream 216" may be combined with the gaseous NG feed stream 212 to form gaseous NG process stream 218, facilitating another pass through the NG processing loop 202, or cooled gaseous NG return stream 216" may be introduced into a pipeline or used for other purposes.

With continued reference to FIG. 2, in the refrigeration path 204, which may be a closed loop that is separate from the NG processing path 202, the gaseous refrigerant stream 262 may be directed from a compressor 266 into a heat exchanger 268. The gaseous refrigerant stream 262 may include a material composition exhibiting favorable characteristics with respect to the composition of the gas of the process stream at a site location of the NG liquefaction plant 200. The at least one compressor 266 may be any known compressor capable of increasing the pressure of the gaseous refrigerant stream 262, such as a single-stage or multiple-stage positive-displacement compressor (e.g., reciprocating compressor, rotary screw compressor), or a single-stage or multiple-stage dynamic compressor (e.g., centrifugal compressor, axial compressor). The heat exchanger 268 may be any known device or apparatus capable of decreasing the temperature gaseous refrigerant stream 262, such as an ambient heat exchanger or a fluid-cooled heat exchanger. The at least one compressor 266 and the at least one heat exchanger 268 may be provided as a single device or as separate devices. In at least some embodiments, the at least one compressor 266 and the at least one heat exchanger 268 are provided as a single, water-cooled, multi-stage positive-displacement compressor. The water-cooling may augment the performance of the multi-stage positive-displacement compressor by increasing the density of the gaseous refrigerant stream 262 before it is introduced into a subsequent stage of the multi-stage positive-displacement compressor. In at least some embodiments, one or more compressors and heat exchangers may be provided downstream of the at least one heat exchanger 268 to further control at least one of the temperature and pressure of the gaseous refrigerant stream 262.

Upon exiting the at least one heat exchanger 268, the gaseous refrigerant stream 262 may be directed into a third channel of the first high efficiency heat exchanger 220, where the gaseous refrigerant stream 262 may be cooled to form an at least partially gaseous refrigerant stream 270, which may include a gaseous phase and a liquid phase. In one or more embodiments, the at least partially gaseous refrigerant stream 270 may be at least substantially gaseous. The at least partially gaseous refrigerant stream 270 may be directed out of the first high efficiency heat exchanger 220 and into a liquid-gas separation vessel 272, wherein the gaseous phase and the liquid phase (if present) of the at least partially gaseous refrigerant stream 270 may be separated to form each of a liquid refrigerant stream 274 and a gaseous refrigerant side stream 276. The liquid refrigerant stream 274 may be directed through a valve 275 and into a mixer 260. The gaseous refrigerant side stream 276 may be directed into a turbo expander 278, to decrease the pressure and temperature of the gaseous refrigerant side stream 276, forming modified gaseous refrigerant side stream 276'. At least in embodiments where the at least partially gaseous refrigerant stream 270 is completely gaseous, the liquid-gas separation vessel 272 may be omitted, and at least partially gaseous refrigerant stream 270 may be fed directly into the turbo expander 278. In at least some embodiments, the turbo expander 278 may also be used to power other components of the NG processing plant 200. For example, the turbo expander 278 may be used to drive an electrical generator (not shown) that produces electrical energy to power an electrical motor (not shown) of at least one of the compressors 256 and 266.

The gaseous refrigerant side stream 276 may be directed from the turbo expander 278 into a mixer 280. At least in embodiments where the at least partially gaseous refrigerant stream 270 is completely gaseous, the mixer 280 may be omitted. Within the mixer 280, the modified gaseous refrigerant side stream 276' may combine with the liquid refrigerant stream 274 and reform the at least partially gaseous refrigerant stream 270'. The at least partially gaseous refrigerant stream 270' may exit the mixer 280 and may flow into a fourth channel the first high efficiency heat exchanger 220, where the at least partially gaseous refrigerant stream 270' may be used to extract heat at least from the gaseous NG process stream 218 and reform the gaseous refrigerant stream 262'. The gaseous refrigerant stream 262' may exit the first high efficiency heat exchanger 220 and may be fed into a second channel of the second high efficiency heat exchanger 221, where the gaseous refrigerant stream 262' may be cooled. Upon exiting the second high efficiency heat exchanger 221, the gaseous refrigerant stream 262' may be directed into the heat exchanger 255, where the gaseous refrigerant stream 262' may extract heat from the gaseous NG return stream 216 to bring the temperatures of the respective streams closer together as noted above. The gaseous refrigerant stream 262' may be directed out of the heat exchanger 255 into at least one compressor 266, facilitating another pass through the refrigeration path 204.

Another embodiment of the present disclosure will now be described with reference to FIG. 3, which schematically illustrates an NG liquefaction plant 300 incorporating carbon dioxide ($CO_2$) cleanup operations. The NG liquefaction plant 300 may include an NG processing path 302 and a refrigeration path 304 (identified relative to the NG processing path 302 by a bold line), each of which are described in detail below.

Figure 3:
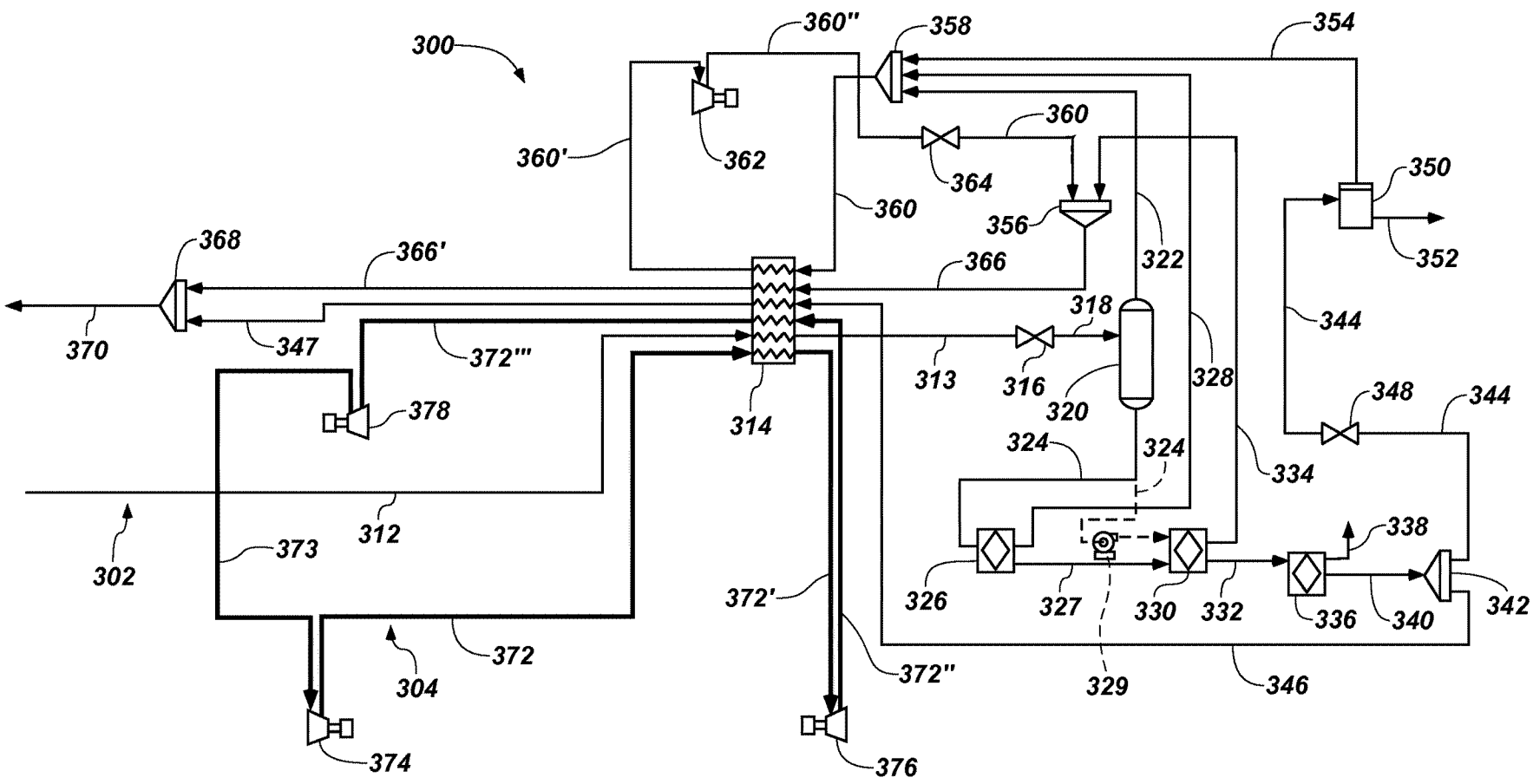
FIG. 3 is a schematic view of a natural gas liquefaction plant, in accordance with yet another embodiment of the present disclosure.

Referring to FIG. 3, in the NG processing path 302, a gaseous NG feed stream 312 may be directed into a primary heat exchanger 314, wherein the temperature of the gaseous NG feed stream 312 may be decreased to form gaseous NG feed stream 313. The gaseous NG feed streams 312, 313 may include impurities, such as $CO_2$. The gaseous NG feed stream 313 may be directed from the primary heat exchanger 314 into a pressure-reducing device 316 such as, by way of non-limiting example, a Joule-Thomson expansion valve, Venturi device, liquid expander, control valve, hydraulic turbine, etc., to form a multi-phase NG process stream 318 including a liquid phase and a gaseous phase. $CO_2$ that may be contained within gaseous NG feed stream 313 may become solidified and suspended in the liquid phase of the multi-phase NG process stream 318 as $CO_2$ has a higher freezing temperature than methane ($CH_4$), which is the primary component of NG. Upon exiting the pressure-reducing device 316, the multi-phase NG process stream 318 may be directed into a gas-liquid separation vessel 320, such as a surge tank. Within the gas-liquid separation vessel 320 the liquid phase and the gaseous phase of the multi-phase NG process stream 318 may be separated to form a separation vessel vent stream 322 and an LNG process stream 324. The LNG process stream 324 may be directed from the gas-liquid separation vessel 320 and into at least one transfer vessel 326 to form a transferred LNG stream 327 and a transfer vessel vent stream 328. The transferred LNG stream 327 may be directed out of the transfer vessel 326 and into a hydrocyclone 330. In one or more embodiments, the at least one transfer vessel 326 may be omitted and a portion of the gas-liquid separation vessel 320 may be used to transfer the LNG stream 324 into a hydrocyclone 330 as shown in broken lines. In such an arrangement, a pump 329 may be utilized to transfer the LNG stream 324 from the gas-liquid separation vessel 320 into the hydrocyclone 330.

Within the hydrocyclone 330, solid $CO_2$ suspended within the transferred LNG stream 327 may be separated to form a $CO_2$-reduced LNG stream 332 and a $CO_2$ slurry stream 334. The hydrocyclone 330 may comprise any suitable device or apparatus known in the art for sorting or separating particles in liquid suspension. Suitable hydrocylcones are commercially available from numerous sources including, but not limited to, Krebs Engineering of Tucson, Ariz. Optionally, in embodiments where the gaseous NG feed stream 312 has minimal $CO_2$, nitrogen, oxygen, ethane, etc., the hydrocyclone 330 may be omitted.

The $CO_2$-reduced LNG stream 332 may be directed through a filter 336, to substantially remove remaining $CO_2$ impurities to form a $CO_2$ waste stream 338 and a substantially $CO_2$-free LNG stream 340. In at least some embodiments, the filter 336 may comprise one screen filter or a plurality of screen filters that are placed in parallel. The $CO_2$ waste stream 338 may be removed from the filter 336 and may be utilized or disposed of as desired. The substantially $CO_2$-free LNG stream 340 may be directed out of the filter 336 and may then be directed into a splitter 342, wherein the substantially $CO_2$-free LNG stream 340 may be separated into a primary LNG stream 344 and an LNG side stream 346. The primary LNG stream 344 may be directed through a valve 348 and into a storage vessel 350. An LNG product stream 352 may be directed from the storage vessel 350 and then may be utilized as desired. The LNG side stream 346 may be directed into a second channel of the primary heat exchanger 314, where the LNG side stream 346 may be used to extract heat at least from the gaseous NG feed stream 312 in the first channel and may be vaporized to form an NG tail gas stream 347. The NG tail gas stream 347 may then be directed from the primary heat exchanger 314 and into a mixer 368 for further treatment, as described in detail below.

The $CO_2$ slurry stream 334 may be directed from the hydrocyclone 330 into a sublimation chamber 356 to sublimate the solid $CO_2$ of the $CO_2$ slurry stream 334 for removal from the NG processing plant 300. Further, at least two of the separation vessel vent stream 322 from the gas-liquid separation vessel 320, the transfer vessel vent stream 328 from the transfer vessel 326, and a storage vessel vent stream 354 from the storage vessel 350, may be mixed or combined within a mixer 358 to form a combined vent stream 360, which may be used to sublimate the $CO_2$ slurry stream 334 within the sublimation chamber 356. It should be noted that the separation vessel vent stream 322 and storage vessel vent stream 354 balance the liquid production and storage vessel pressures. As shown in FIG. 3, the combined vent stream 360 may exit the mixer 358 and may be passed through a third channel of the primary heat exchanger 314 to extract heat at least from the gaseous NG feed stream 312 in the first channel of the primary heat exchanger 314 and form modified combined vent stream 360'. The modified combined vent stream 360' may then be directed through a compressor 362, which may be used to increase the pressure and temperature of the modified combined vent stream 360'. Upon exiting the compressor 362, a compressed combined vent stream 360" may be directed through a valve 364, and into the sublimation chamber 356. In some embodiments, a heat exchanger, such as described in application Ser. No. 11/855,071, filed Sep. 13, 2007, titled Heat Exchanger and Associated Method, owned by the assignee of the present invention, the disclosure thereof previously incorporated by reference in its entirely herein, may be utilized as the sublimation chamber 356. Optionally, in embodiments where the gaseous NG feed stream 312 has minimal impurities (e.g., $CO_2$, nitrogen, oxygen, ethane, etc.) the sublimation chamber 356 may be replaced by a mixer.

A $CO_2$ tail gas stream 366 may exit the sublimation chamber 356 and may be directed into a fourth channel of the primary heat exchanger 314 to extract heat at least from the gaseous NG feed stream 312 in the first channel of the primary heat exchanger 314. The heated $CO_2$ tail gas stream 366' may be directed out of the primary heat exchanger 314 and into the mixer 368. Within the mixer 368, the heated $CO_2$ tail gas stream 366' may be mixed or combined with the NG tail gas stream 347 to form a combined tail gas stream 370. The combined tail gas stream 370 may be directed out of the mixer 368, and may be utilized as desired.

With continued reference to FIG. 3, in the refrigeration path 304, which may be a closed loop that is isolated from the NG processing path 302, a gaseous refrigerant stream 372 may be passed from a turbo compressor 374 into a fifth channel of the primary heat exchanger 314, where the temperature of the gaseous refrigerant stream 372 may be decreased to form cooled gaseous refrigerant stream 372'. After passing through the primary heat exchanger 314, the cooled gaseous refrigerant stream 372' may be directed into a turbo expander 376, to decrease the pressure and temperature of the cooled gaseous refrigerant stream 372'. The modified gaseous refrigerant stream 372" may be directed from the turbo expander 376 into a sixth channel of the primary heat exchanger 314, where the modified gaseous refrigerant stream 372" may be used to extract heat at least from the gaseous NG feed stream 312. The heated gaseous refrigerant stream 372'" may exit the primary heat exchanger 314 and may be directed into at least one compressor 378, such as single-stage or multiple-stage positive-displacement compressor (e.g., reciprocating compressor, rotary screw compressor), or a single-stage or multiple-stage dynamic compressor (e.g., centrifugal compressor, axial compressor). The compressed gaseous refrigerant stream 373 may be directed out of the at least one compressor 378 and back into the turbo compressor 374, facilitating another pass through the refrigeration path 304.

The use of a refrigeration path 304 that is separate from the NG process path 302 may advantageously enable the refrigeration path 304 to utilize refrigerants that do not include impurities such as $CO_2$. In at least some situations, refrigerants including $CO_2$ may impose limitations on design parameters (e.g., temperatures, pressures, etc.) of the NG processing plant 300. Utilizing refrigerants that do not include impurities such as $CO_2$ may avoid such design parameter limitations, facilitating increased process flexibility and efficiency relative to previous NG liquefaction technologies. The use of a separate refrigeration path 304 may also increase process efficiency relative to previous NG liquefaction technologies by keeping refrigerants contained within the NG processing plant 300, rather than directing the refrigerants into a tail gas stream (e.g., the combined tail gas stream 370) exiting the NG processing plant 300. While not depicted in the context of FIG. 3, refrigeration path 304 may include components similar to those described with respect to the embodiments of FIGS. 1 and 2, such as coolers downstream of compressors, and liquid separation tanks.

Embodiments of the present disclosure may be utilized to liquefy NG in a wide variety of locations having a wide variety of NG feed stream configurations. In many locations where NG liquefaction is desired, utilizing embodiments of the present disclosure may be favorable at least because utilizing a refrigeration path that is separate from an NG processing path enables the refrigeration path to include material compositions and/or operating parameters (e.g., pressures, temperatures, flow rates) that are different than those of the NG processing path, which may facilitate advantageous process and plant efficiencies.

While the present disclosure may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the scope of the invention as defined by the following appended claims and their legal equivalents. For example, elements and features disclosed in relation to one embodiment may be combined with elements and features disclosed in relation to other embodiments of the present invention.

What is claimed is:

1. A method of liquefying natural gas, the method comprising:

cooling a compressed gaseous refrigerant stream of a refrigerant loop in a channel of a heat exchanger to form a partially gaseous refrigerant stream comprising a gaseous phase and a liquid phase;

separating the gaseous phase from the liquid phase in a separation vessel downstream of the channel of the heat exchanger to form a gaseous refrigerant side stream and a liquid refrigerant stream;

expanding the gaseous refrigerant side stream in an expansion device downstream of the separation vessel;

combining the expanded, gaseous refrigerant side stream with the liquid refrigerant stream in a mixer downstream of the expansion device to form another partially gaseous refrigerant stream; and directing the another partially gaseous refrigerant stream into another channel of the heat exchanger downstream of the mixer prior to modifying a temperature of the another partially gaseous refrigerant stream to extract heat from a natural gas process stream of a natural gas processing path fluidly separate from the refrigerant loop to liquefy at least a portion of the natural gas process stream and form a gaseous refrigerant stream.

2. The method of claim 1, further comprising forming the compressed gaseous refrigerant stream of the refrigerant loop to exhibit the same material composition the natural gas process stream of the natural gas processing path.

3. The method of claim 2, further comprising maintaining at least one of different pressures, temperatures and flow rates in the refrigerant loop and the natural gas processing path.

4. The method of claim 1, further comprising forming the compressed gaseous refrigerant stream of the refrigerant loop to exhibit a different material composition than the natural gas process stream of the natural gas processing path, the compressed gaseous refrigerant stream comprising at least one of methane, ethane, and propane.

5. The method of claim 4, further comprising selecting the compressed gaseous refrigerant stream to be devoid of $CO_2$.

6. The method of claim 1, wherein expanding the gaseous refrigerant side stream in the expansion device downstream of the separation vessel comprises expanding the gaseous refrigerant side stream in a turbo expander.

7. The method of claim 4, further comprising forming the compressed gaseous refrigerant stream from the group consisting essentially of methane, ethane, propane, and nitrogen.

8. A method of natural gas liquefaction, the method comprising:

compressing a gaseous refrigerant stream in a refrigerant loop received from a first channel of a multi-pass heat exchanger;

cooling the compressed gaseous refrigerant stream in a second channel of the multi-pass heat exchanger to form an at least partially gaseous refrigerant stream;

directing the at least partially gaseous refrigerant stream through a separation vessel downstream of the second channel of the multi-pass heat exchanger to separate a gaseous phase of the at least partially gaseous refrigerant stream from a liquid phase of the at least partially gaseous refrigerant stream;

expanding the gaseous phase of the at least partially gaseous refrigerant stream in an expansion device downstream of the separation vessel and upstream of the first channel of a multi-pass heat exchanger to form at least one expanded, at least partially gaseous refrigerant stream;

directing at least a gaseous phase of the expanded, at least partially gaseous refrigerant stream into the first channel of the multi-pass heat exchanger prior to modifying a temperature of the gaseous phase to extract heat from a gaseous natural gas process stream in a path separate from the refrigerant loop passing through a third channel of the multi-pass heat exchanger and form a cooled gaseous natural gas process stream and the gaseous refrigerant stream;

expanding the cooled gaseous natural gas process stream to form a multi-phase natural gas process stream exhibiting a liquid phase and a gaseous phase; and directing a portion of the liquid phase of the multi-phase natural gas process stream into a fourth channel of the multi-pass heat exchanger to extract additional heat from the gaseous natural gas process stream and form a gaseous natural gas side stream.

9. The method of claim 8, wherein the gaseous refrigerant stream, the at least partially gaseous refrigerant stream, and the gaseous phase of the at least partially gaseous refrigerant stream are of a different composition than the gaseous natural gas process stream and the liquid natural gas processing stream.

10. The method of claim 8, further comprising combining the gaseous phase of the at least partially gaseous refrigerant stream and the liquid phase of the at least partially gaseous refrigerant stream in a mixer upstream of the first channel of the multi-pass heat exchanger to reform the at least partially gaseous refrigerant stream.

11. The method of claim 8, wherein directing a portion of the liquid phase of the multi-phase natural gas process stream into a fourth channel of the multi-pass heat exchanger comprises:

splitting the liquid phase of the of the multi-phase natural gas process stream into a primary liquid natural gas stream and a liquid natural gas side stream; and directing the liquid natural gas side stream into the fourth channel of the multi-pass heat exchanger to extract heat from at least the gaseous natural gas process stream and form a gaseous natural gas side stream.

12. The method of claim 11, wherein splitting the liquid phase of the multi-phase natural gas process stream into a primary liquid natural gas stream and a liquid natural gas side stream comprises selecting a mass ratio of the primary liquid natural gas stream and the liquid natural gas side stream to be within a range of from about 3:1 to about 9:1.

13. The method of claim 12, further comprising:

directing the primary liquid natural gas stream into a storage vessel;

mixing the gaseous phase of the multi-phase natural gas process stream with a gaseous vent stream from the storage vessel to form a combined vent stream; and directing the combined vent stream into a fifth channel of the multi-pass heat exchanger to extract further heat from the gaseous natural gas process stream and form a heated combined vent stream.

14. The method of claim 13, further comprising:

mixing the gaseous natural gas side stream with the heated combined vent stream to form a gaseous natural gas return stream;

compressing the gaseous natural gas return stream;

cooling the compressed gaseous natural gas return stream; and combining the cooled, compressed gaseous natural gas return stream with a natural gas feed stream to form the gaseous natural gas process stream.

15. The method of claim 14, further comprising selecting a mass ratio of the refrigerant loop and the natural gas feed stream to be about 7.75:1.

16. The method of claim 14, further comprising directing a portion of the gaseous natural gas process stream into the compressed gaseous refrigerant stream before directing the compressed gaseous refrigerant stream into the second channel of the multi-pass heat exchanger.

17. The method of claim 14, further comprising directing a portion of the gaseous natural gas process stream into the gaseous refrigerant stream before compressing the gaseous refrigerant stream.

* * * * *